US010955229B2

(12) United States Patent
Kedairy

(10) Patent No.: US 10,955,229 B2
(45) **Date of Patent: *Mar. 23, 2021**

(54) FIREARM CARTRIDGE

(71) Applicant: Skychase Holdings Corporation, Fort Lauderdale, FL (US)

(72) Inventor: Faisal Kedairy, Vienna (AT)

(73) Assignee: Skychase Holdings Corporation, Alachua, FL (US)

( * ) Notice: Subject to any disclaimer, the term of this patent is extended or adjusted under 35 U.S.C. 154(b) by 197 days.

This patent is subject to a terminal disclaimer.

(21) Appl. No.: 15/331,275

(22) Filed: Oct. 21, 2016

(65) Prior Publication Data

US 2017/0038182 A1 Feb. 9, 2017

Related U.S. Application Data

(63) Continuation-in-part of application No. 15/049,698, filed on Feb. 22, 2016.

(60) Provisional application No. 62/119,543, filed on Feb. 23, 2015.

(51) Int. Cl.

| | |
|---|---|
| ***F42B 12/76*** | (2006.01) |
| ***F42B 5/02*** | (2006.01) |
| ***F42B 5/26*** | (2006.01) |

(52) U.S. Cl.

CPC ..... *F42B 12/76* (2013.01); *F42B 5/02* (2013.01); *F42B 5/025* (2013.01); *F42B 5/26* (2013.01)

(58) Field of Classification Search

CPC ..... F42B 5/00; F42B 5/02; F42B 5/08; F42B 5/025; F42B 5/26; F42B 5/28; F42B 5/285; F42B 5/30; F42B 5/307; F42B 5/34; F42B 12/76

USPC ..... 102/430, 439, 464–472

See application file for complete search history.

(56) References Cited

U.S. PATENT DOCUMENTS

| | | | | |
|---|---|---|---|---|
| 6,293,203 | B1 * | 9/2001 | Alexander | F42B 5/025 102/430 |
| 2006/0090664 | A1 * | 5/2006 | Stock, Jr. | F42B 5/025 102/464 |
| 2009/0211483 | A1 * | 8/2009 | Kramer | F42B 5/025 102/439 |
| 2011/0214583 | A1 * | 9/2011 | Dutch | F42B 5/025 102/464 |

FOREIGN PATENT DOCUMENTS

WO 2005008167 A2 1/2005

OTHER PUBLICATIONS

Ammo Encyclopedia, Bussard, Michael, Blue Book Publications, Inc., 50th Edition (Aug. 18, 2014).

(Continued)

*Primary Examiner* — Jonathan C Weber

(74) *Attorney, Agent, or Firm* — Whitmyer IP Group LLC

(57) ABSTRACT

The present invention is an improved .30 caliber cartridge that overcomes the limitations of the prior art by providing a centerfire cartridge with a case having a head with a rim, a body extending from the head to a tapered shoulder to a mouth that seats a bullet. The cartridge having a dimension that is short enough to fit in an automatic pistol's magazine and when fired from such a pistol's barrel will achieve ballistics closely resembling that of a rifle carbine.

21 Claims, 2 Drawing Sheets

(56) References Cited

OTHER PUBLICATIONS

Cartridges of the World, Barnes, Frank C., Gun Digest Books, 14th Edition (Dec. 19, 2014).
International Search Report of ISA/EP, dated Apr. 13, 2016, for PCT/AT2016/050036.

* cited by examiner

| | | |
|---|---|---|
| 1- | 7.45 - 7.86 mm. | |
| 2- | 21.60 mm. | (±0.2) |
| 3- | 19.00 mm. | (±0.2) |
| 4- | 10.75 mm. | (±0.2) |
| 5- | 10.80 mm. | (±0.2) |
| 6- | 8.55 mm. | (±0.2) |
| 7- | 10.85 mm. | (±0.2) |
| 8- | a) 4.4 mm. | (±0.2) |
| | b) 5.30 mm. | (±0.2) |
| 9- | a) 1.4 mm. | (±0.2) |
| | b) 2.00 mm. | (+0.2) |
| 10- | 9.65 mm. | (±1.2) |
| 11- | 3.63 mm. | (±0.2) |
| 12- | 8.45 mm. | (±0.2) |
| 13- | 7.79 mm. | (±0.2) |
| 14- | 25.00 mm. | (±0.2) |
| 15- | 35.00 mm. | (±0.2) |

| | | |
|---|---|---|
| 1- | 7.45 - 7.86 mm. | |
| 2- | 21.60 mm. | (±0.2) |
| 3- | 19.00 mm. | (±0.2) |
| 4- | 10.75 mm. | (±0.2) |
| 5- | 10.80 mm. | (±0.2) |
| 6- | 8.55 mm. | (±0.2) |
| 7- | 10.85 mm. | (±0.2) |
| 8- | a) 4.4 mm. | (±0.2) |
| | b) 5.30 mm. | (±0.2) |
| 9- | a) 1.4 mm. | (±0.2) |
| | b) 2.00 mm. | (+0.2) |
| 10- | 9.65 mm. | (±1.2) |
| 11- | 3.63 mm. | (±0.2) |
| 12- | 8.45 mm. | (±0.2) |
| 13- | 7.79 mm. | (±0.2) |
| 14- | 25.00 mm. | (±0.2) |
| 15- | 35.00 mm. | (±0.2) |

FIREARM CARTRIDGE

FIELD OF THE INVENTION

The present invention pertains to a firearm cartridge, and in particular to a cartridge case. In a particular aspect, the present invention relates to an improved .30 caliber cartridge that overcomes the limitations of the prior art.

BACKGROUND

Relevant prior art references that teach .30 caliber cartridges include: Ammo Encyclopedia by Michael Bussard, Blue Book Publications, Inc., 50th edition (18 Aug. 2014); Cartridges of the World by Frank C. Barnes, Gun Digest Books 14th edition (19 Dec. 2014); Quick Load Interior Ballistic Program V 3.8 (2013).

As is the norm in the prior art, the cartridge case includes a cylindrical body portion with a central aperture in the head end for the placement of a primer and a cartridge extraction groove formed around the periphery of the body portion adjacent to the head end. A frusto-conical shoulder portion tapers radically inwardly from the body portion and a generally cylindrical neck portion extends longitudinally from the shoulder portion.

Precise and accurate pistol shooting requires the optimization of velocity, chamber pressure and the correct ratio between projectile weight and caliber [i.e., sectional density] as calculated by the formulas well known to the people of the art.

A firearm is designed to produce a predictable velocity and accuracy outcome for a range of projectiles [bullets] intended to be tired from a designed cartridge. A firearm is designed to support the operation and tolerances needed for the cartridge to perform as designed. Prior art in pistol cartridge design constrains the upper limit on velocity and accuracy due to the geometry of the case design as it has to fit in a magazine that fits in a frame that has to fit in a regular-size human hand that is gripping it. In addition, modern pistols are designed to operate within certain limits on chamber pressure.

For longer range, precision shooting, it is desirable to send heavier caliber projectiles at higher velocities without exceeding the standard chamber pressure operational parameters of regular modern pistol frame designs.

Previous cartridge designs attempting to improve longer range ballistics for pistols have used either a) smaller caliber lighter projectiles such as the 57×28 mm FN, or the 4.6×30 mm HK, which resulted in a much reduced external and terminal ballistic profile due to the unfavorable weight to caliber ratio [sectional density] and the lower kinetic energy retained of the lighter and smaller projectile; or b) high case volume revolver cartridges with heavy projectiles in specially designed pistols, which rendered the pistols with a lower magazine capacity, a grip size that is too big for regular human hand size and recoil action that is very difficult to control by shooters, and subsequently the inability to shoot accurately.

Therefore, it would be advantageous to remedy the deficiencies inherent in the prior art.

SUMMARY OF THE INVENTION

The present invention has optimized the powder capacity to chamber pressure ratio by having the optimal case geometry and shoulder angle in relation to projectile weight and caliber ratio, thus giving this cartridge case the ability of attaining velocities that significantly exceed those of the prior art while achieving higher external ballistics results, in addition to terminal ballistics due to the higher sectional densities of the projectiles that can be used in this cartridge.

It is a goal of this invention to provide a new and improved cartridge, and specifically a case with new geometry previously not know in the art, for use in firearms and specifically pistols. Another goal of the present invention is to provide a new and improved cartridge for pistols that optimizes propellant combustion without substantially increasing the size of the cartridge case. Another goal of the present invention is to provide a new and improved cartridge for pistols that optimally places projectiles within the cartridge and supports heavier projectiles in ratio to the caliber that are required to attain longer range accuracy and effectiveness.

In order to meet the goals specified above, the inventor has developed a firearm cartridge, and more specifically a pistol cartridge, that produces increased velocity from a cartridge case that is short enough to fit a standard pistol frame, large capacity double stack magazine and is able to be used at longer ranges more accurately than normal pistol cartridges of the prior art.

According to embodiments of the invention, a centerfire cartridge is provided with a case having a head with a rim, a body extending from the head to a tapered shoulder to a mouth that seats a bullet. Further, the cartridge may have a dimension that is short enough to fit in an automatic pistol's magazine and when fired from such a pistol's barrel will achieve ballistics closely resembling that of a rifle carbine.

BRIEF DESCRIPTION OF THE DRAWINGS

In the following, the present invention is described in more detail with reference to the drawings, in which.

DETAILED DESCRIPTION OF EMBODIMENTS OF THE INVENTION

Figure 1:
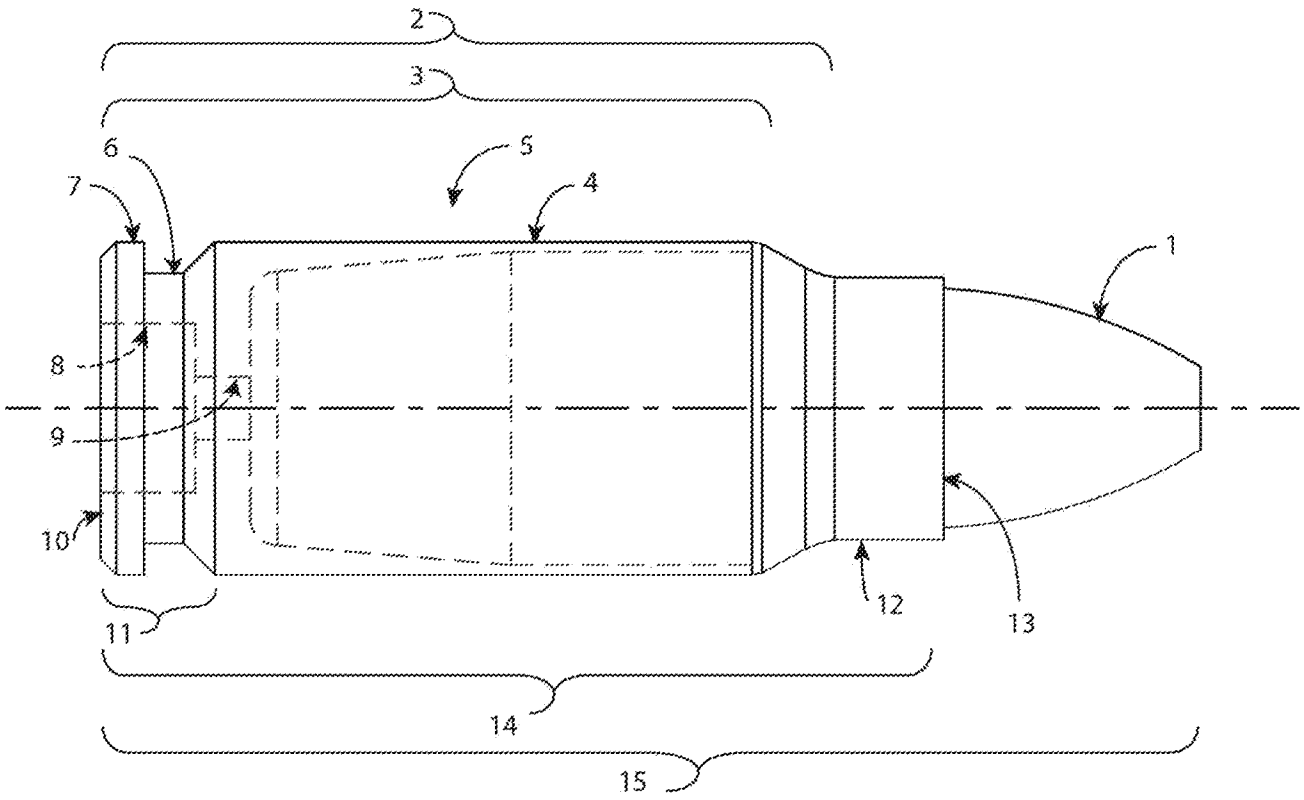
FIG. 1 is a side view of the cartridge.
Figure 2:
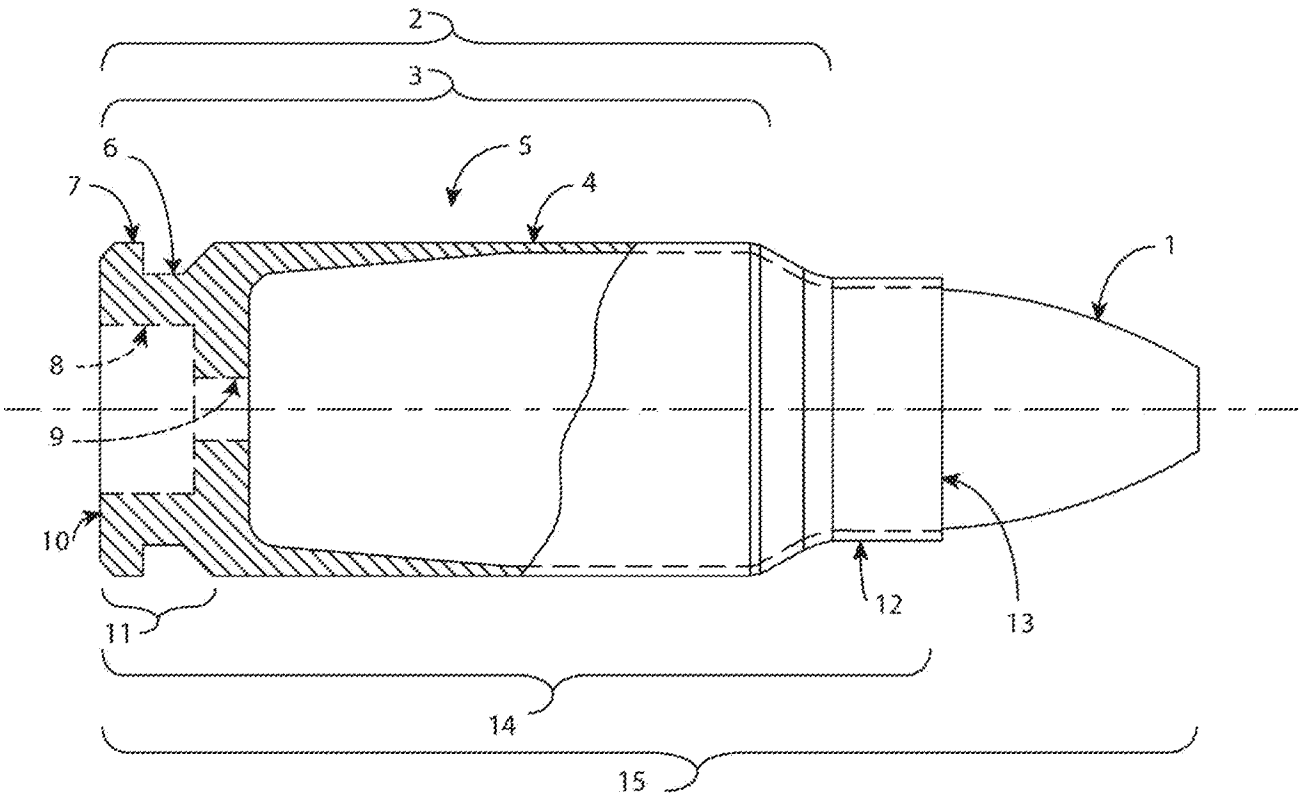
FIG. 2 is a sectional side view of a lateral cut of the cartridge.

FIGS. 1 and 2 illustrate a center fire pistol cartridge designated "7.5 FK Short", which will be discussed hereinafter in relation to exemplary and non-restrictive embodiments. It will be evident to the person skilled in the art to freely combine several or all of the embodiments discussed here as deemed suitable for a specific application of the invention. Throughout this disclosure, terms like "advantageous", "exemplary" or "preferred" indicate elements or dimensions which are particularly suitable (but not essential) to the invention or an embodiment thereof, and may be modified wherever deemed suitable by the skilled person, except where expressly required.

In one embodiment a center fire pistol cartridge comprises: a case having a head (11) having a rim (10), a body extending from the head to a tapered shoulder, a neck (12) extending from the shoulder and defining a mouth receiving a bullet (13); the body having a straight external surface free of a protruding belt; the body having a maximum diameter sized to closely fit for operation within a standard action of an automatic pistol and magazine (5); the cartridge case having an overall length (14) sized to closely fit for operation within a standard semiautomatic action selected from the group of standard actions and contain a primer pocket (8) linked to a powder chamber through a fire hole (9); wherein the body (5) has a maximum diameter of between 10.65 and 10.95 mm; and wherein the cartridge has a preferred overall length (15) of between 25.00 and 35.20 mm.

Also indicated in the figures are the bullet (1) with a diameter of 7.45 to 7.86 mm, the diameter (7) of the rim (10) and a groove (6) adjacent to the rim, the rim diameter (7) being, e.g., 10.85 mm, and the groove having a diameter of, e.g., 8.55 mm.

Preferably, the cartridge has an overall length sized to closely fit for operation within a standard semiautomatic pistol. In one of the preferred embodiments of the invention the case of the cartridge has an overall length (14) of between 24.80 and 25.20 mm.

In another preferred embodiment the shoulder of the cartridge has a diameter (12) of approximately 8.45 mm at a position (2, 3) between 19.00 and 21.60 mm from an end face of the head.

In a further preferred embodiment the cartridge contains a bullet with a maximum diameter (13) of between 7.59 and 7.99 mm.

In a further embodiment the cartridge comprises a body (4), the body (4) having a diameter of between 10.65 and 10.95 mm at an approximate position 17.37 mm from an end face of the head.

In some embodiments, the cartridge has a ratio of overall length to body diameter at a location proximate to the head of less than or equal to 2.79.

It is also possible that the cartridge has a ratio of overall length to body diameter at a location proximate to the head of greater than or equal to 2.58.

It is generally advantageous that the entire body of the cartridge may have a consistent surface finish, although it need not.

It may also be of advantage that the rim of the cartridge has substantially the same diameter as a rear portion of the body proximate to the rim.

In another embodiment according to this invention, a center fire pistol cartridge comprises: a case having a head (11) having a rim (10), a body extending from the head to a tapered shoulder, a neck (12) extending from the shoulder and defining a mouth receiving a bullet (13); the body having a straight external surface free of a protruding belt; the body having a maximum diameter sized to closely fit for operation within a standard action of an automatic pistol and magazine (5); wherein the body has a maximum diameter equal to 10.80 mm; and wherein the cartridge has an overall length (15) equal to or more than 34.80 mm.

In this embodiment the cartridge preferably has an overall length (14) sized to closely fit for operation within a standard semiautomatic pistol in one of the variations of this embodiment the case of the cartridge has an overall length (14) of between 24.80 and 25.20 mm (14).

In another variation of this embodiment the shoulder (12) of the cartridge has a diameter of approximately 8.45 mm at a position between 19.00 and 21.60 mm from an end face of the head (see reference symbols 2, 3 and 12).

It can also be of advantage that the bullet (1) of the cartridge in this embodiment has a maximum diameter (13) of between 7.59 and 7.99 mm, and the body (5) of the cartridge in this embodiment has a diameter of between 10.65 and 10.95 mm.

It is conceivable that the cartridge has a ratio of overall length to body diameter at a location proximate to the head of less than or equal to 2.79 and has a ratio of overall length to body diameter at a location proximate to the head of greater than or equal to 2.58.

It is generally advantageous that the entire body of the cartridge may have a consistent surface finish, although it need not.

It can be of advantage that the rim of the cartridge of this embodiment of the invention has substantially the same diameter as a rear portion of the body proximate to the rim.

It is also conceivable in all embodiments that were discussed above that the cartridge has a primer pocket (8) which has a diameter of between 4.20 and 4.60 mm, and a fire hole (9) which has a diameter of between 1.20 and 1.60 mm or it has a primer pocket (8) which has a diameter of between 5.10 and 5.50 mm, and a fire hole which has a diameter of between 1.80 and 220 mm (9).

The invention claimed is:

1. A firearm cartridge configured for employment by a center fire pistol, the firearm cartridge comprising:

a bullet having a bullet diameter greater than or equal to 7.45 mm and less than or equal to 7.74 mm;

a case having a head having a rim, the case having a body extending from the head to a tapered shoulder, the body having a body diameter at the tapered shoulder, the case having a neck extending from the tapered shoulder and defining a mouth retaining the bullet, the case containing a primer pocket linked to a powder chamber through a flash hole, the powder ignition column having a powder chamber length extending from a center of the flash hole through the tapered shoulder to the neck;

wherein the body diameter divided by the bullet diameter is greater than or equal to 1.372 and less than or equal to 1.469;

wherein the powder chamber length is greater than or equal to 17.57 mm and less than or equal to 18.37 mm;

wherein the powder chamber length divided by the bullet diameter is greater than or equal to 2.27 and less than or equal to 2.4; and wherein the tapered shoulder has a diameter of approximately 8.45 mm at a position between 19.0 mm and 21.6 mm from an end face of the head.

2. The firearm cartridge according to claim 1, further comprising an overall cartridge length less than or equal to 35.2 mm.

3. The firearm cartridge according to claim 1, further comprising an overall cartridge length greater than or equal to 25.0 mm and less than or equal to 35.2 mm.

4. The firearm cartridge according to claim 1, wherein the rim has a rim diameter greater than or equal to 10.65 mm and less than or equal to 11.05 mm.

5. The firearm cartridge according to claim 1, wherein the case has an overall case length less than or equal to 25.2 mm.

6. The firearm cartridge according to claim 1, wherein the case has an overall case length greater than or equal to 24.8 mm and less than or equal to 25.2 mm.

7. The firearm cartridge according to claim 1, wherein the primer pocket has a primer pocket diameter than or equal to 4.2 mm and less than or equal to 4.6 mm.

8. The firearm cartridge according to claim 7, wherein the flash hole has a flash hole diameter greater than or equal to 1.2 mm and less than or equal to 1.6 mm.

9. The firearm cartridge according to claim 1, wherein the primer pocket has a primer pocket diameter greater than or equal to 5.1 mm and less than or equal to 5.5 mm.

10. The firearm cartridge according to claim 9, wherein the flash hole has a flash hole diameter greater than or equal to 1.8 mm and less than or equal to 2.2 mm.

11. The firearm cartridge according to claim 1, wherein the body has a body diameter greater than or equal to 10.55 mm and less than or equal to 10.95 mm, and wherein the cartridge has an overall length of greater than or equal to 34.80 mm.

12. The firearm cartridge according to claim 11, wherein the case has an overall case length greater than or equal to 24.8 mm and less than or equal to 25.2 mm, and wherein the overall case length divided by the body diameter is less than or equal to 2.39.

13. The firearm cartridge according to claim 11, wherein the case has an overall case length greater than or equal to 24.8 mm and less than or equal to 25.2 mm, and wherein the overall case length divided by the body diameter is greater than or equal to 2.26.

14. The firearm cartridge according to claim 1, wherein the body has a consistent surface finish.

15. The firearm cartridge according to claim 1, wherein the neck has a diameter greater than or equal to 8.25 mm and less than or equal to 8.65 mm.

16. The firearm cartridge according to claim 1, wherein the case has an overall case length greater than or equal to 24.8 mm and less than or equal to 25.2 mm, and wherein the overall case length divided by the bullet diameter is less than or equal to 3.39.

17. The firearm cartridge according to claim 1, wherein the case has an overall case length greater than or equal to 24.8 mm and less than or equal to 25.2 mm, and wherein the overall case length divided by the bullet diameter is greater than or equal to 3.11.

18. The firearm cartridge according to claim 1, wherein the tapered shoulder having a shoulder angle of approximately 30 degrees.

19. A firearm cartridge configured to be fired by a center fire pistol, the firearm cartridge comprising:

a bullet having a bullet diameter greater than or equal to 7.45 mm and less than or equal to 7.86 mm;

a case having a head with a rim, the case having an overall case length greater than or equal to 24.8 mm and less than or equal to 25.2 mm;

the case having a body extending from the head to a tapered shoulder, the body having a straight external surface and a maximum body diameter greater than or equal to 10.65 mm and less than or equal to 10.95 mm;

the case having a neck which extends from the tapered shoulder and has a mouth for retaining the bullet; and the case containing a primer pocket linked to a powder chamber through a flash hole, the powder chamber having a powder chamber length extending from a center of the flash hole through the tapered shoulder to the neck, the powder chamber length being greater than or equal to 17.57 mm and less than or equal to 18.37 mm, and the powder chamber length divided by the body diameter being greater than or equal to 1.60 and less than or equal to 1.72;

wherein the tapered shoulder has a diameter of approximately 8.45 mm at a position between 19.0 mm and 21.6 mm from an end face of the head.

20. A firearm cartridge configured to be fired by a center fire pistol, the firearm cartridge comprising:

a bullet having a bullet diameter greater than or equal to 7.45 mm and less than or equal to 7.86 mm;

a case having a head with a rim, the case having an overall case length greater than or equal to 24.8 mm and less than or equal to 25.2 mm;

the case having a body extending from the head to a tapered shoulder, the body having a straight external surface and a maximum body diameter greater than or equal to 10.65 mm and less than or equal to 10.95 mm;

the tapered shoulder having a diameter of approximately 8.45 mm at a position between 19.0 mm and 21.6 mm from an end face of the head, and the tapered shoulder having a shoulder angle of approximately 30 degrees;

the case having a neck which extends from the tapered shoulder and having a mouth for retaining the bullet; and the case containing a primer pocket linked to a powder chamber through a flash hole.

21. The firearm cartridge according to claim 1 further comprising a groove adjacent to the rim, wherein the rim has a diameter of 10.85 mm, and the groove has a diameter of 8.55 mm.

* * * * *